US005443542A

United States Patent [19]

Khoury

[11] Patent Number: 5,443,542

[45] Date of Patent: Aug. 22, 1995

[54] REVOLVER BARREL WITH IMPROVED BARREL THROAT AND METHOD OF MANUFACTURE

[75] Inventor: Donald S. Khoury, Granby, Mass.

[73] Assignee: Colt's Manufacturing Company Inc., West Hartford, Conn.

[21] Appl. No.: 353,517

[22] Filed: Dec. 9, 1994

[51] Int. Cl.[6] ..... F41C 3/14; F41A 21/16; B23P 13/00

[52] U.S. Cl. ..... 42/59; 42/76.01; 29/1.1

[58] Field of Search ..... 42/59, 76.01, 78; 29/1.1

[56] References Cited

U.S. PATENT DOCUMENTS

| | | | |
|---|---|---|---|
| 144,814 | 11/1873 | Williamson . | |
| 3,136,084 | 6/1964 | Charron | 42/59 |
| 3,176,422 | 4/1965 | Harris | 42/59 |
| 4,253,261 | 3/1981 | Schmidt | 42/59 |
| 4,387,526 | 6/1983 | Brouthers et al. | 42/59 |
| 4,651,456 | 3/1987 | Ghisoni | 42/62 |
| 4,793,084 | 12/1988 | Beltzer | 42/59 |
| 5,333,531 | 8/1994 | Field | 89/26 |

*Primary Examiner*—Charles T. Jordan
*Assistant Examiner*—Theresa M. Wesson
*Attorney, Agent, or Firm*—Perman & Green

[57] ABSTRACT

A revolver having a barrel and a cartridge cylinder. The barrel has a rifled barrel bore, a barrel throat, and an entrance into the barrel throat. The barrel throat is located at a rear end of the barrel bore and has a general cone shape. The entrance is located at a rear end of the barrel throat and has a uniform constant diameter. The rear end of the barrel can be reduced to adjust a gap between the rear end of the barrel and the cylinder without having to re-work the barrel throat.

12 Claims, 1 Drawing Sheet

FIG. 1
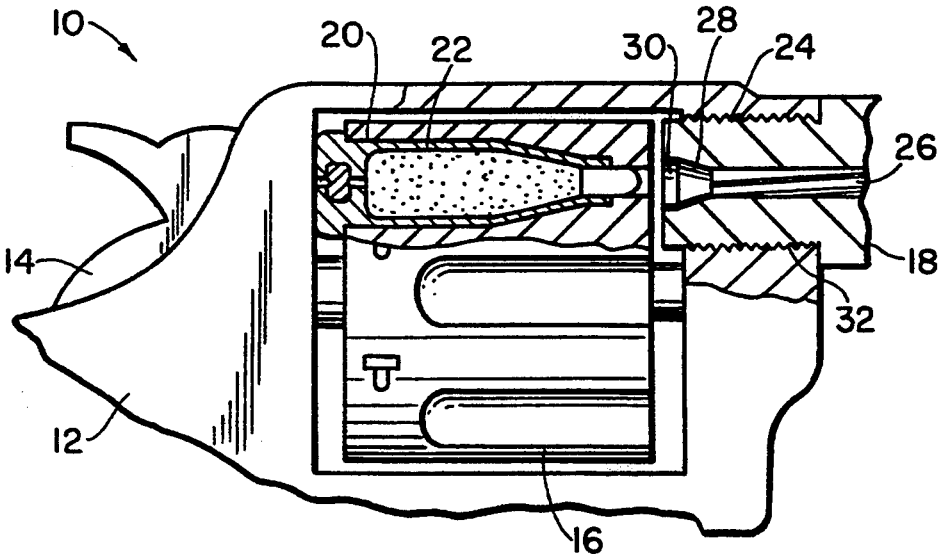
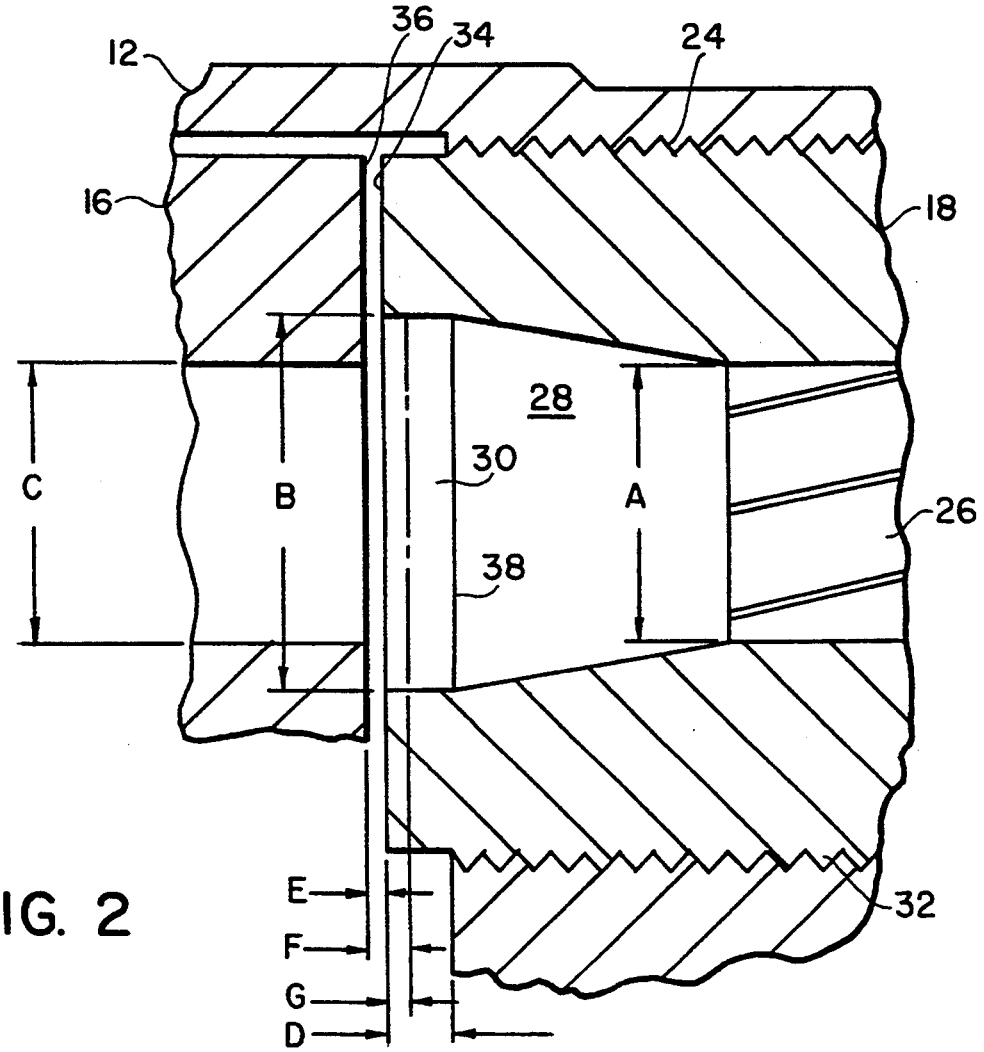
FIG. 2

REVOLVER BARREL WITH IMPROVED BARREL THROAT AND METHOD OF MANUFACTURE

BACKGROUND OF THE INVENTION

1. Field of the Invention

The present invention relates to firearms and, more particularly, to a barrel for a revolver and a method of manufacturing the revolver.

2. Prior Art

U.S. Pat. No. 3,176,422 discloses a rear end of a revolver barrel with a frusto-conical sink in the rear end of the barrel. U.S. Pat. No. 4,387,526 discloses a barrel throat with two tapers. The following U.S. Pat. Nos. show revolver barrels with cone shaped barrel throats:

| | |
|---|---|
| 144,814 | 3,136,084 |
| 4,253,261 | 4,651,456 |
| 4,793,084 | 5,333,531 |

SUMMARY OF THE INVENTION

In accordance with one method of the present invention a method of a manufacturing a barrel for a revolver is provided comprising steps of providing a barrel member with a rifled barrel bore; forming a barrel throat at a rear end of the barrel bore, the barrel throat having a diameter that decreases along the length of the throat; and forming an entrance at a rear end of the barrel throat with a constant diameter along the length of the entrance.

In accordance with another method of the present invention a method of manufacturing a revolver is provided comprising steps of providing a barrel; attaching the barrel to a frame; and removing a portion of a rear end of the barrel. The barrel has a barrel throat at a rear end of a barrel bore and an entrance at a rear end of the barrel throat. The entrance has a substantially constant diameter and the barrel throat has a diameter that decreases along the length of the barrel throat. The step of removing a portion of the rear end of the barrel removes the portion along a portion of the entrance to adjust a gap between the rear end of the barrel and a front end of a cylinder.

In accordance with one embodiment of the present invention, a revolver barrel is provided comprising a rifled barrel bore, a barrel throat, and an entrance. The barrel throat has a general cone shape and is located at a rear end of the barrel bore. The entrance is located at a rear end of the barrel throat and has a constant diameter along the length of the entrance.

BRIEF DESCRIPTION OF THE DRAWINGS

The foregoing aspects and other features of the invention are explained in the following description, taken in connection with the accompanying drawings, wherein:

FIG. 1 is a partial side view with a cut-away section of a revolver incorporating features of the present invention; and FIG. 2 is an enlarged cross-sectional view of the barrel, frame and cylinder shown in FIG. 1 before a rear portion of the barrel is removed.

DETAILED DESCRIPTION OF THE PREFERRED EMBODIMENT

Referring to FIG. 1, there is shown a partial view of a revolver 10 incorporating features of the present invention. Although the present invention will be described with reference to the single embodiment shown in the drawings, it should be understood that features of the present invention can be incorporated into various different types of alternate embodiments and firearms. In addition, any suitable size, shape or type of members, elements or materials could be used.

The revolver 10 generally comprises a frame 12, a hammer 14, a cartridge cylinder 16, and a barrel 18. The cylinder 16 is revolvably connected to the frame 12 and includes a plurality of cartridge chambers 20 for holding cartridges 22. Referring also to FIG. 2, the frame 12 has a threaded hole 24 that is adapted to receive the barrel 18. The barrel 18 has a rifled barrel bore 26, a barrel throat 28 at a rear end of the bore 26, and an entrance 30 at a rear end of the barrel throat 28. The rifled barrel bore 26 has a diameter A. The entrance 30 has a uniform constant diameter B that is larger than the diameter A. The barrel throat 28 has a general cone shape. The diameter of the barrel throat 28 decreases along the length of the throat from the entrance 30 to the barrel bore 26. The diameter B of the entrance 30 is the same size as the diameter of the barrel throat at the rear end 38 of the barrel throat 28. The front of the cartridge chambers 20 have a diameter C that is smaller than the diameter B.

The exterior of the rear end of the barrel 18 has a threaded area 32 that is adapted to be screwed into area 24 of the frame. However, any suitable type of means to fixedly connect the barrel to the frame could be used. The threaded area 32 extends around or surrounds the barrel throat 28 and a portion of the bore 26. However, the threaded area 32 does not surround the entrance 30. Thus, a non-threaded area or distance D is provided on the exterior rear end of the barrel. In the embodiment shown, the area D is substantially the same length as the length of the entrance 30.

The barrel 18 is formed by forming a bore, the barrel throat 28, and entrance 30 in a barrel member. Then the bore is rifled to form the rifled bore 26. The screw threads are also formed on the exterior of the barrel member surrounding the barrel throat 28, but not surrounding the entrance 30. The barrel 18 is then attached to the frame 12 at threaded area 24. Then, a barrel/cylinder gap E is measured between the rear edge 34 of the barrel 18 and the front surface 36 of the cylinder 16. The gap E is compared to a predetermined desired gap size F between the rear edge 34 and front surface 36. The difference G between the real gap E and the desired gap F is then determined. The manufacturer can now remove a portion of the rear end of the barrel 18 equal to the length G to thereby adjust the real gap into becoming the desired gap F. The portion of the barrel 18 that is removed can be removed by any suitable type of metal machining process, such as grinding. The barrel 18 could be removed from the frame 12 during this machining process or could remain attached to the frame while being machined. Preferably, after the portion along length G of the rear end of the barrel 18 is removed, the barrel/cylinder gap between the rear edge 34 and front surface 36 is measured again to insure that the real gap is now substantially the same as the desired gap F.

As is generally known in the art, a cone shaped barrel throat reduces particle spitting, such as gun powder, lead, and jacket material from a fired cartridge. Also, as is generally known in the art, manufacturers in the past have adjusted the barrel/cylinder gap between a rear end of a barrel and front of a cylinder by removing a portion of the rear end of the barrel. However, because barrel throats in the past started at the rear edge of the barrel, because diameters of the cone shaped barrel throats decreased along their lengths, and because removing a portion of a barrel length to adjust the barrel/cylinder gap was sometimes necessary, the size of a barrel throat would change. More specifically, the length of the barrel throat would become smaller and, the rear end diameter of the barrel throat would become smaller. In order to correct this problem, the barrel throat had to be re-worked or machined again. This re-work usually deteriorated the surface finish of the barrel throat which aggravated particle spitting.

The present invention eliminates secondary re-work operations on a barrel after a rear end of the barrel has been shortened in order to meet gun specifications for a desired barrel/cylinder gap. In addition, the present invention does not aggravate particle spitting from the barrel/cylinder gap. Because the barrel 18 has an entrance 30 between the rear edge 34 of the barrel 18 and the rear end 38 of the cone shaped barrel throat 28, the rear end 38 of the barrel throat 28 is spaced from the rear edge 34 by the distance D. Thus, if a portion of the rear end of the barrel 18 needs to be removed, it will only be removed at the area of the entrance 30; not along the cone shaped barrel throat 28. The length and size of the throat 28 will not be changed because its rear end 38 is located inside (or will be located inside) the frame 12. Because the entrance 30 has the constant and uniform diameter B, the diameter of the entrance 30 will not change when a portion of the rear end of the barrel 18 is removed. The diameter B at rear end 38 of the throat 28 remains constant even when length G is altered to adjust the barrel/cylinder gap.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A method of manufacturing a barrel for a revolver comprising steps of:

providing a barrel member with a rifled barrel bore;

forming a barrel throat at a rear end of the barrel bore, the barrel throat having a diameter that decreases along the length of the throat; and forming an entrance at a rear end of the barrel throat with a constant diameter along the length of the entrance.

2. A method as in claim 1 wherein the step of forming an entrance comprises forming the diameter of the entrance the same size as a rear end diameter of the barrel throat.

3. A method as in claim 1 further comprising attaching the barrel member to a frame of the revolver and measuring a gap between the rear end of the barrel member and a cartridge cylinder of the revolver.

4. A method as in claim 3 further comprising removing a portion of the rear end of the barrel member to thereby adjust the gap between the rear end of the barrel member and the cartridge cylinder.

5. A method as in claim 1 further comprising forming screw threads on an exterior of the barrel member surrounding the barrel throat, but not surrounding the entrance.

6. A method of manufacturing a revolver comprising steps of:

providing a barrel with a barrel throat at a rear end of a barrel bore and an entrance at a rear end of the barrel throat, the entrance having a substantially constant diameter and the barrel throat having a diameter that decreases along the length of the barrel throat;

attaching the barrel to a frame; and removing a portion of a rear end of the barrel along a portion of the entrance to adjust a gap between the rear end of the barrel and a front end of a cylinder.

7. A method as in claim 6 further comprising measuring the gap after the barrel is attached to the frame to determine the size of the gap.

8. A method as in claim 7 further comprising removing the barrel from the frame before removing the portion of the rear end of the barrel.

9. A method as in claim 8 further comprising reattaching the barrel to the frame after removing the portion and measuring the gap again.

10. A revolver barrel comprising:

a rifled barrel bore;

a general cone shaped barrel throat at a rear end of the barrel bore; and an entrance at a rear end of the barrel throat having a constant diameter along the length of the entrance.

11. A revolver barrel as in claim 10 wherein the diameter of the entrance is the same size as a diameter of the barrel throat at the rear end of the barrel throat.

12. A revolver barrel as in claim 10 further comprising a screw thread area on an exterior of the barrel surrounding the barrel throat and not surrounding the entrance.

* * * * *